United States Patent [19]

Noren

[11] Patent Number: 4,781,206

[45] Date of Patent: Nov. 1, 1988

[54] LOW ENERGY, LOW WATER CONSUMPTION WAREWASHER

[75] Inventor: Tore H. Noren, Petaluma, Calif.

[73] Assignee: The Stero Company, Petaluma, Calif.

[21] Appl. No.: 850,635

[22] Filed: Apr. 11, 1986

[51] Int. Cl.[4] ..... B08B 3/02

[52] U.S. Cl. ..... 134/174; 134/186; 134/191

[58] Field of Search ..... 134/174, 186, 191, 195, 134/199, 200

[56] References Cited

U.S. PATENT DOCUMENTS

| | | | |
|---|---|---|---|
| 2,764,169 | 9/1956 | Bazarnic | 134/186 |
| 3,068,877 | 12/1962 | Jacobs | 134/186 |
| 3,108,607 | 10/1963 | Blakeslee | 134/191 |
| 3,319,651 | 5/1967 | Ullman | 134/186 |
| 3,465,761 | 9/1969 | Meeker et al. | 134/58 |
| 3,903,909 | 9/1975 | Noren et al. | 134/58 |
| 4,088,145 | 5/1978 | Noren | 134/104 |
| 4,218,264 | 8/1980 | Federighi | 134/58 |
| 4,439,242 | 3/1984 | Hedden | 134/25.2 |

*Primary Examiner*—Harvey C. Hornsby
*Assistant Examiner*—Corinne M. Reinckens
*Attorney, Agent, or Firm*—Biebel, French & Nauman

[57] ABSTRACT

A commercial warewasher consecutively washes racks of soiled ware, such as dishes, through a machine cycle which includes recirculating wash water over the ware followed by a fresh water spray rinse. Part of the wash water is drained and a second portion is retained in the machine after each rack of dishes is washed, then combined with subsequent fresh rinse water spray to provide a volume of water sufficient for pumped wash recirculation for the next rack without cavitation. When a drain valve is opened, water pressure to the wash arm system is reduced, flow through it decreases, and when the pump stops the wash system will drain by gravity to the lowest point in the wash system plumbing. In the meantime the pump discharges wash water until the level of water in the sump and/or its associated outlet pipe reaches the level of the pump impeller eye. The pump begins to cavitate and effectively ceases to pump water. The pump and its drive motor are mounted outside the perimeter of the cabinet, with the pump impeller inverted and the drive motor extending vertically above the pump, leaving substantial open space between the supporting floor and the underside of the machine for ease of cleaning and maintenance in a crowded kitchen environment.

4 Claims, 1 Drawing Sheet

LOW ENERGY, LOW WATER CONSUMPTION WAREWASHER

CROSS-REFERENCE TO RELATED APPLICATION

This application is related to copending U.S. application Ser. No. 833,946 filed 26 February 1986 and assigned to the same entity.

BACKGROUND OF THE INVENTION

This invention relates primarily to a warewasher for washing dishes, utensils, glasses and the like in commercial establishments such as restaurants, particularly "fast food" restaurants, and cafeterias.

The terms warewasher is used herein to refer to washing machines used in commercial establishments, e.g. restaurant, cafeteria, or "fast food" kitchens, to wash and sanitize dishes and other kitchen utensils and devices. Commercial warewashers (to which this invention is directed), are distinguished from a "domestic" diswasher, the type commonly found in a home. Domestic and commercial machines differ substantially in design and manner of use, with the exception of a few commercial machine styles which are an outgrowth of heavy duty domestic machine designs. Even in this relatively minor exception, the machines differ in function and operation, not only in the length of time it takes to wash and rinse a rack of ware, but also in the number of washes and rinses per rack. Domestic units ordinarily have the capability of drying washed dishes within the wash chamber, whereas commercial units feature a wash period using a washing solution (usually with detergent), a short rinse period with hot fresh water, and air drying outside the chamber in order to minimize the time it takes to complete each rack of ware. It is important in a commercial environment to wash a large number of racks of ware successively in rapid order.

Domestic dishwashers may operate as long as 60 to 90 minutes to complete washing, rinsing and drying a single rack of dishes per day, whereas a commercial machine will wash and rinse a rack of ware in two to three minutes or less and require their immediate removal and replacement with the next rack. It is rare in a domestic machine to wash consecutive racks or loads of dishes, whereas it is routine in the commercial environment.

The type of commercial warewasher to which this invention is applicable is commonly referred to as a "stationary rack machine" i.e., a unit with an enclosable wash chamber in which a rack of ware is placed, washed, rinsed, and then removed and replaced by a second rack of dishes, while the cleansed rack is air dried outside the chamber, as distinguished from larger commercial warewashers which utilize conveyors to carry racks of ware through the machine. There are two main types of stationary rack warewashers, one type commonly referred to in the trade as a "fill-and-dump" (hereinafter fill/dump) machine and a second type which has a large volume tank or reservoir, commonly called a "recirculating" machine or "tank" machine.

In a fill/dump machine, a single batch of water is typically used for each rack of dishes to be washed, in the following fashion. A sump in the wash chamber is filled with water, detergent added to make wash water, and a rack of soiled ware placed in the chamber. The wash water is recirculated by a pump through a wash arm or arms having spray nozzles which spray the ware under relatively high pressure to loosen and remove the soil from the ware. A drain valve is then opened to drain the sump of wash water by gravity into a waste line, the drain valve is then closed and a water line is opened to fill the emptied sump with fresh rinse water. This rinse water is then recirculated by the same pump and wash arm to rinse the ware. Upon completion of rinsing, the rack of rinsed dishes is removed from the chamber, but the rinse water is retained to serve as wash water for the next rack of dishes, and detergent is typically added either automatically or by hand before the next rack of soiled ware is loaded into the machine.

Although the single batch of water is used as rinse water for one rack and then subsequently used as wash water for the next following rack, the end result (except for the first fill) is that one batch of water is used for each rack of dishes, but the filling and draining of water does not coincide with the beginning and end of a machine cycle. Examples of patents illustrating the type of dishwasher referred to herein are U.S. Pat. No. 4,088,145 issued May 9, 1978 to Tore H. Noren and U.S. Pat. No. 4,218,264 issued Aug. 19, 1980 to George J. Federighi and George B. Federighi. A variation of this type of unit is illustrated in U.S. Pat. No. 3,903,909 issued Sept. 9, 1975 to Tore H. Noren and George J. Federighi, in which the batch of fresh water is introduced through the wash system to flush the wash system.

Although each of these patents hows a variety of different designs and functions, they essentially show the basics of a fill/dump machine, namely the recirculation of rinse water through the same instrumentalities that carried the wash water, and subsequently using the rinse water as wash water for the next rack of dishes. With such machines it is necessary to add enough rinse water to serve as the proper volume of wash water for a next rack of dishes. Such machines need to add enough rinse fill each cycle to satisfy the supply, without cavitation, of the pump which circulates the wash water and, in most designs, the rinse water as well. The amount is frequently stated as being at least 1.7 gallons (6.435 liters) of rinse water, but frequently exceeds 2 gallons (7.57 liters) and sometimes is as high as 3 gallons (11.355 liters) per rack.

In the "recirculating" or "tank" dishwasher, the tank is a relatively large reservoir (e.g. 16 gallons or 60.56 liters) which is originally filled with water and enough detergent supplied for the proper concentration for washing. This water or wash liquid is used over and over, washing successive racks with most of the same liquid. A dedicated fresh water spray system rinses the rack of ware at the proper time in a cycle, after it has been washed by pumped recirculation, thus rinse water falling to the tank dilutes the wash water somewhat each cycle. The term "dedicated" means that the rinse system is used to carry only fresh water and not transport soiled wash water. A drain valve is located at the bottom of the tank. The valve is part of an open vertical standpipe which provides an overflow level near the top of the tank as the rinse water continues to accumulate.

A primary purpose for using the tank system is to provide a significant volume of wash water on the dishes, even though that water is reused and tends to become soiled if not watched. The water is typically heated by a heater, and acts as a heat sink to maintain water temperature. The rinse water descends to the top of the pool of wash water, and a fairly large percentage of the rinse water may overflow through the standpipe and out to the drain. The tank itself is ordinarily drained only every few hours, at which time the water in the reservoir is usually fairly soiled. Strainers are provided to catch any large particles of food or other material washed from the dishes and keep them from reaching the sump wash liquid. Detergent is replenished as needed. To drain the tank, the standpipe is lifted, and in so doing the entire large volume reservoir is drained by gravity into a floor drain.

An example of the type of system described as a tank system is shown in U.S. Pat. No. 4,439,242 issued Mar. 27, 1984 to James P. Hadden. One advantage of the tank system over the fill/dump system is that as little as 1.2 to 1.4 gallons (4.542 to 5.299 liters) of rinse water needs to be used per rack. With the large volume of water available for pumped wash recirculation, rinse water added through the dedicated rinse system can be a minimum quantity required to do an effective rinsing job.

In addition to these primary types of washers, there exists fill/dump machines which utilize dedicated fresh water rinse systems of a type similar to those used in tank machines. Such machines are completely drained of wash water by gravity directly to a floor drain, and, as will be shown, are incapable of providing the energy and water savings of this invention, without specific modifications to achieve the intended objectives. These fill/dump machines require similar volumes of water per rack as the previously discussed fill/dump machines, to satisfy wash pump needs.

In terms of water temperature, commercial dishwashers are available in what the trade refers to as low temperature and high temperature machines. This simply means that the rinse water in a low temperature machine may be at 130°-140° F. (54° to 60° C.) and include a sanitizing agent such as sodium hypochlorite (common household bleach), or, in the case of a high temperature machine, the rinse water has a minimum sanitizing temperature of 180° F. (82° C.) to meet public health standards in the United States. It should be understood the invention disclosed and claimed herein is useful in either low temperature or high temperature machines if the objective of obtaining water and/or energy savings is achieved.

SUMMARY OF THE INVENTION

The invention provides a type of warewasher which employs certain of the advantages of a fill/dump unit without necessitating use of as much water and energy, and also is capable of having the water and energy savings advantages of a tank machine. It functions in certain respects like a tank machine, but uses cleaner wash water and avoids loss of any of the freshest and hottest water to a drain, as happens to some extent in a tank machine. The latter features are attributes of a fill/dump machine.

For an understanding of the functioning of a machine according to the invention, certain requirements of a stationary rack commercial dishwasher should be addressed first, primarily as an example, and not a limitation.

A typical recirculation pump for the wash system requires a minimum of about 1.5 gallons (5.678 liters) of water in the sump to prevent pump starvation due to cavitation. But 1.5 gallons is not only borderline in the amount of water that needs to be recirculated onto the ware to do an effective washing job, it also fails to recognize that much water is out of the sump during wash recirculation. For example, the recirculating wash pump disclosed herein delivers 60 gallons of water per minute (227 liters/min) through a pair of wash arms and tubing connected thereto. The tubing and the arms themselves hold a substantial proportion of the 1.5 minimum gallons required. That, coupled with the facts that spray is suspended in the chamber and water must drip from the dishes and sides of the wash chamber, 1.5 gallons is ordinarily insufficient to supply a pump having such a large flow capacity. Fill/dump machines of the type which have been described above utilize anywhere from 1.7 to about 3 gallons of water in order to satisfy the washing requirements of the wash system.

To provide the larger volume of wash water according to the invention, there is a deliberate retention of a portion of the wash water by preventing it from going to the waste line or drain upon completion of washing. While this is unsatisfactory for good rinsing results in most fill/dump machines known heretofore, retention of wash water at the end of a wash portion of a cycle permits an operation of what appears to be a fill/dump design of dishwasher in a manner somewhat like a recirculating tank-type system. This necessitates, however, the use of a dedicated fresh water rise system, which is standard in many machines. But due to retention of some wash water each cycle the invention can accomplish both effective washing and rinsing with less water and energy usage.

In a preferred form, the invention provides a warewasher structure which retains some wash water by preventing its being drained at the end of the wash portion of a cycle. A centrifugal pump removes some but not all of the wash water at the end of the wash period, preferably pumping the wash water to a waste line which may be located at a higher level than the sump. The retained water, though soiled, has added to it the fresh water which is supplied during the folowing rinse period by dedicated rinse nozzles for rinsing the ware, and thus there results a larger volume of wash water for the next rack of ware.

In so doing, it is possible to use less water for rinsing, on the order of 1.5 gallons (5.678 liters) per rack, collecting another 0.75 to 1 gallon (2.839 to 3.785 liters) of water via retention from the previous wash, and thus having almost 2.5 gallons (9.463 liters) of water available for pumped recirculation for the next wash. That 2.5 gallons is adequate to supply the wash pump without cavitation, and in so doing, allows less water to be used for rinsing. This saves not only water, but also the expense of energy and detergents (and sanitizing chemicals in the case of a low temperature machine) since their proportions are necessarily related to the amount of water used per rack. In essence, in this preferred design, although 1.5 gallons of water is added to each cycle by rinsing, the wash recirculating pump is performing with perhaps 2.5 gallons (9.463 liters) of water, quite adequate to satisfy its needs to do an effective washing job.

The primary object of the invention, therefore, is to provide a commercial warewasher having an operating cycle which includes a wash period using recirculated wash water and a rinse period using fresh rinse water from a dedicated rinse system, and which inherently retains a portion of the wash water for use in washing during the next cycle, and collects the fresh rinse water in the rinse period along with the retained wash water, the volume of rinse water and duration of rinsing being an approximate minimum to perform effective rinsing; to provide a warewasher wherein the total retained wash water and collected rinse water combining in the sump provide, for a next following rack of ware, a wash water volume which is substantially in excess of that supplied by the rinse system alone; to provide such a machine wherein the retained quantity of wash water is at least 25% of the total volume of wash water used each cycle; to provide a novel commercial dishwasher in which a recirculating pump, wash arms and dedicated rinse nozzles are designed such that at the end of a wash period a predetermined quantity of wash water is retained in the machine; and to provide a pumping arrangement for such a machine which will automatically accomplish the retaining function, will pump wash water to a higher elevation drain, and which is located outside the perimeter of the machine cabinet for easy service access and to allow a large access space under the cabinet, between the bottom wall and the supporting surface, for cleaning.

Other objects and advantages of the invention will be apparent from the following description, the accompanying drawings and the appended claims.

DESCRIPTION OF THE PREFERRED EMBODIMENT

Figure 1:
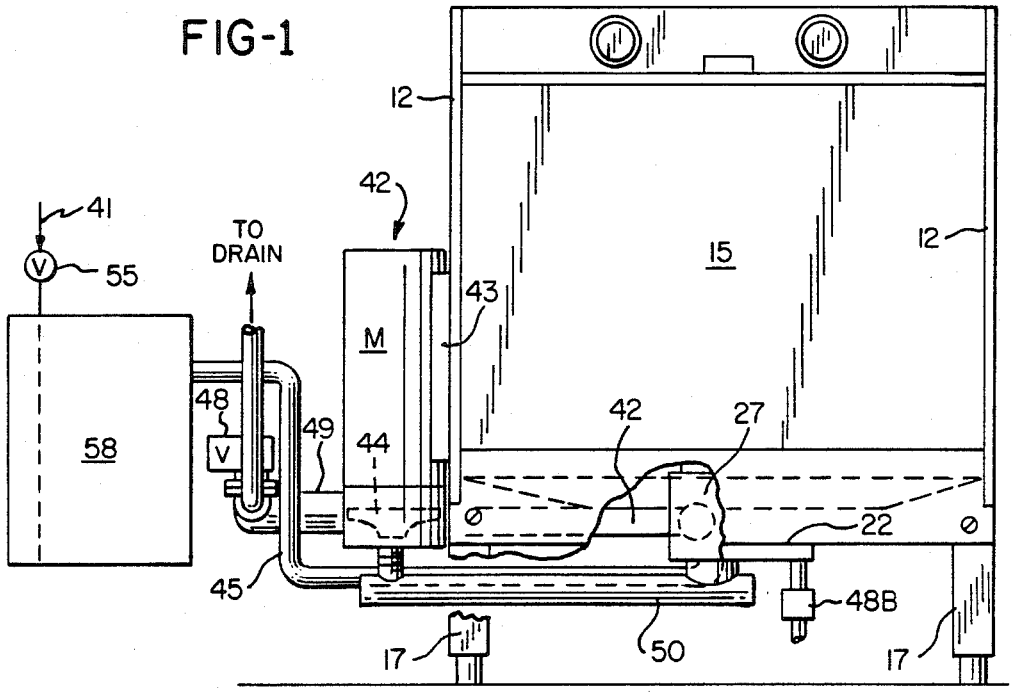
FIG. 1 is a frontal view of an undercounter commercial dishwasher incorporating the features of the invention, and including an optional preheating water tank.
Figure 2:
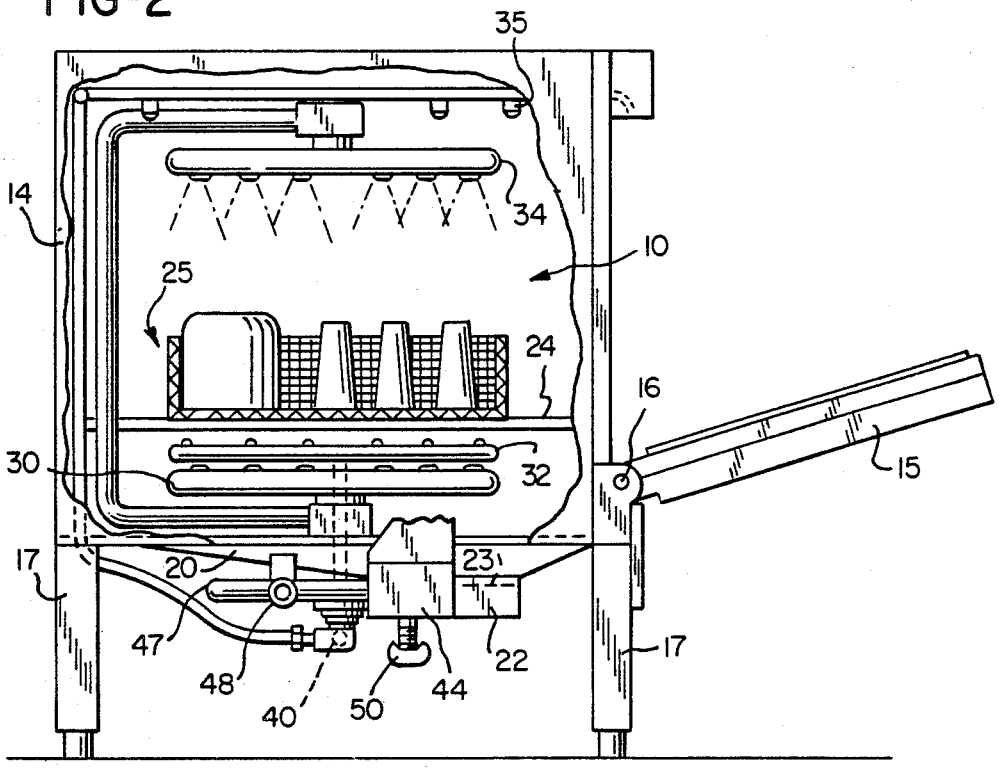
FIG. 2 is a side view of the dishwasher shown in FIG. 1, with part of the cabinet broken away to show details of the wash and rinse systems and associated plumbing.

Referring to FIGS. 1 and 2, the dishwashing machine includes a washing/rinsing chamber 10 which is defined by a cabinet, usually formed of stainless steel panels and components, and including a top wall 11, side walls 12 and rear wall 14, and a front facing door 15, hinged at its lower end, as indicated at 16. The chamber 10 is vented to ambient pressure through labyrinth seals (not shown) near the top wall, and the seal between the door edges and the cabinet preferably is also a labyrinth seal. The cabinet is supported upon legs 17 which rest on the supporting surface (e.g. a kitchen floor) and provide the necessary clearance under the machine to permit cleaning beneath it as required by various local sanitation codes. At the bottom of the chamber, as part of the sloping bottom wall 20 of the cabinet, is a relatively small sump 22 which may have a removable strainer cover 23. It is possible that a large plumbing elbow can serve the function of a sump because of the use of an outlet pipe or tube extending therefrom, as described below.

Above the bottom wall, rails 24 provide support for standard ware racks 25, loaded with ware to be washed and sanitized, which are loaded and unloaded through the front door. A coaxial fitting 27 is supported on the lower wall 20, centrally of the chamber, and this fitting in turn provides support for a lower wash arm 30 and lower rinse arm 32, each of conventional reaction type. An upper wash arm 34 and upper rinse spray heads 36 are supported from the top wall of the chamber.

The fresh hot rinse water supply line 40 extends from a source of hot water (e.g, a heating tank as later described) and is connected to the rinse arm 32 and rinse spray heads 36. The wash water supply line 41 is connected to the upper and lower wash arms 34 and 30, and receives wash water from an electric motor driven pump 42 mounted just outside the perimeter of the cabinet, for example to one side of and exterior of the cabinet as shown. The pump is preferably a centrifugal pump with a direct drive from a motor M, mounted in inverted fashion to a side of the cabinet by a suitable bracket 43 as shown, and includes a casing 44 surrounding a centrifugal impeller 45 rotatably mounted in the casing. A central inlet 46 is located at the eye of the impeller, and a pump outlet 47 extends from one side of the casing. The pump is supplied from an outlet pipe 50 that extends from sump 22 and returns or recirculates the wash water sprayed over the ware in the rack during the wash period of the machine cycle. The volumetric capacity of sump 22 and outlet pipe 50, along with the height location of the inlet or eye of the impeller in drain pump 42, are important to the features of the invention, and are later described in greater detail in connection with the machine operating cycle. Thus, during the wash portion of an operating cycle, pump 42 functions as a recirculating pump means.

A solenoid operated drain valve 48 is connected by a branch or drain pipe 55 to the wash water supply line 41 immediately downstream of the outlet of pump 42, and this valve when open allows flow of the pump discharge to a drain line 57 that may be connected into a suitable kitchen drain system, according to the applicable code regulations. In many kitchens in newer fast food restaurants the drain system may be considerably above the floor, thus the pumped discharge from the dishwasher is a desired feature in those installations. Also, when the drain valve is open, the path of least resistance to the pump output is through drain valve 48, and flow through the recirculating wash plumbing quickly diminishes due to back pressure created at the nozzles of the wash arms. At this time the pump 45 functions as a drain pump means. During the normal cycle of operations of this machine, as later described, drain valve 48 is opened once each cycle of operation, after the wash period and before the rinse period of the cycle. .

A solenoid-operated fill valve 55 is connected, in the embodiment shown, to control the supply of fresh water to a booster heater 58, which is a displacement type heater tank having its inlet connected to receive water through fill valve 55, and its outlet connected to the fresh rinse water supply line 40. The booster heater has a heating element with a capacity of (typically) 6 kW, and has the usual pressure relief valve 59 which will divert hot water through an overflow pipe in the event the tank pressure exceeds a predetermined value. In the usual case, the booster heater operates at water line pressure, which normally is about 60 to 90 psig.(4.219 to 6.328 kg/cm$^2$ gage) and supplies water at 180° F. (82° C.) or above in accordance with NSF (National Sanitation Foundation) regulations.

The booster heater can be omitted if a source of 180° F. water is otherwise available, in the case of a high temperature machine, or if lower temperature rinse water is used together with a sanitizing agent, e.g. in a low temperature machine. In those cases the fill valve 55 is simply connected between the supply and the rinse water line 40 and the water supply temperature may be in the order of 140° F. (60° C.).

Also, a low capacity (e.g. 500 W) heater may be fitted to sump 22. Such a heater may be, for example, a wire or similar heating strip embodied in an elastomeric pad that can be adhered to the exterior of the sump to heat water in the machine by conduction, if necessary. An optional auxiliary drain valve 48B can also be connected into the bottom of sump 22 to permit total draining of the sump at the end of a period of use, if this feature is desired. However, as will be seen, any water retained in the sump 22 and outlet pipe 47 is essentially fresh rinse water that has been sprayed once over the ware in the machine and then collected. Thus this water, especially in the small retained quantity according to the invention, could be retained for a considerable period without concern.

Machine Operating Cycle

An explanation of the operating cycle assumes that the machine has been filled initially, that a loaded rack of soiled ware is in the wash chamber, the drain valve is closed, and the door is closed. An appropriate charge of detergent is added to the water, either manually before the door is closed or automatically when the door is closed and this action is detected. Preferably the control proceeds through a short reset term of a few seconds. Then the pump 42 is started and wash water (detergent added) is recirculated through the wash arms onto the ware, draining back to the sump and to the pump inlet, with pump 42 functioning as a recirculation pump means. This segment of the cycle continues for about forty-one seconds, then the drain valve 50 is opened and the pump continues to run, discharging wash water to drain.

After a period of about seventeen seconds, the pump is stopped. During that time, the pump discharges about 1.5 gallons of the wash water before the pump begins to cavitate, and retains 0.8 gallon. When the drain valve is opened, water pressure to the upper and lower wash arms is reduced, flow through them decreases, and the wash arms and their associated plumbing will drain by gravity to the lowest point, which is the nozzles of the lower wash arm, when the pump stops. In the meantime, pump 42, now functioning as a drain pump means together with the open drain valve, discharges wash water until the level of water in sump 22 and the associated outlet pipe 50 reaches the level of the pump impeller eye, at which time the pump begins to cavitate and effectively ceases to pump water. Thus the 0.8 gallon of retained wash water is made up of whatever remains in the outlet pipe and sump at this time, plus whatever rains into the sump from the wash water plumbing after the pump stops.

A short dwell period of about two seconds follows, after which the fresh water fill valve 55 opens and fresh hot rinse water is supplied to the rinse arm 32 and spray heads 36 under supply pressure. This flow continues for about twenty-two seconds, which is sufficient to thoroughly rinse and sanitize the ware in the case of a high temperature machine. In the case of a low temperature machine, sodium hypochlorite (or other sanitizing agent) may be injected into the flow of rinse water, in known fashion. The amount of fresh rinse water added during this period is 1.5 gallons. The fill valve is then closed, a dwell period of about three seconds preferably follows during which the rack of ware drains and the fresh water plumbing drains down to the level of the nozzles in the lower rinse arm, and the rack of cleansed ware is unloaded. The sump contains a full charge of 2.3 gallons, which is retained and has detergent added to it to serve as wash water in the next cycle. Details of a control circuit and system suitable for the foregoing purposes, are described in detain in said copending U.S. application Ser. No. 833,946.

While the apparatus herein described constitutes a preferred embodiment of this invention, it is to be understood that the invention is not limited to this precise form of apparatus, and that changes may be made in the apparatus without departing from the scope of the invention, which is defined in the appended claims.

What is claimed is:

1. In a commercial warewasher for undercounter installation, said warewasher having a cabinet including top, bottom, side and rear walls joined to form a washing chamber and a front door on said cabinet providing access to load and unload ware from said chamber, said bottom including a sump for collecting liquid and an outlet connection on said sump, spray means in said chamber for spraying washing liquid on ware supported therein;

the improvement comprising a centrifugal pump having a casing and an impeller rotatable in said casing and a drive motor for rotating said impeller, said pump being located outside the perimeter of said cabinet, said pump casing having an inlet connection and an outlet tube extending to said spray means, said pump inlet connection being located substantially in a horizontal plane extending through said outlet connection of said sump, an outlet pipe extending from said sump outlet connection to said pump inlet connection at an elevation at least partially below said pump inlet connection and the bottom of said sump;

whereby decrease in the liquid level in said chamber to said sump outlet connection will cause cavitation in said impeller to stop effective output from said pump while a quantity of liquid remains in said outlet pipe; and a drain line extending from said pump outlet connection and a normally closed drain valve in said drain line, opening of said drain valve allowing the output of said pump to flow directly to a drain and to said spray means until cavitation of said impeller stops the pump output.

2. A warewasher as defined in claim 1, wherein said pump impeller is mounted to rotate about a vertical axis located externally of said side and/or rear walls of said chamber with said inlet connection facing downward, and said motor is mounted above said impeller.

3. A warewasher as defined in claim 2, including bracket means attached to one side of the exterior of said cabinet and supporting said pump and motor therefrom.

4. In a commercial warewasher for undercounter installation, a cabinet including top, bottom, side and rear walls joined to form a washing chamber and a front door on said cabinet providing access to load and unload ware from said chamber, leg means supporting said cabinet with said bottom spaced substantially above a supporting surface, said bottom including a sump for collecting liquid and an outlet connection extending from the bottom of said sump, spray means in said chamber for spraying washing liquid on ware supported therein;

a centrifugal pump having a casing and an impeller rotatable in said casing and a drive motor directly driving said impeller, said pump casing having an inlet connection at one end of said casing and an outlet connection at one side of said casing, means supporting said pump outside the perimeter of said cabinet with said pump inlet connection facing downward and a tube adjacent said bottom wall connecting said pump outlet connection to said spray means, an outlet pipe extending from said sump outlet connection to said inlet connection adjacent the underside of said bottom to leave a substantial access space beneath said bottom wall and the supporting surface on which said cabinet is located; and a drain line extending from said pump outlet connection and a normally closed drain valve in said drain line, opening of said drain valve allowing the output of said pump to flow directly to a drain and to said spray means until cavitation of said impeller stops the pump output.

* * * * *